US012385171B2

(12) United States Patent
Self et al.

(10) Patent No.: US 12,385,171 B2
(45) **Date of Patent: *Aug. 12, 2025**

(54) FLAME RESISTANT FABRICS

(71) Applicant: Southern Mills, Inc., Union City, GA (US)

(72) Inventors: Robert Self, Peachtree City, GA (US); Keith Edward Pickering, Decatur, GA (US)

(73) Assignee: Southern Mills, Inc., Union City, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/391,826

(22) Filed: Dec. 21, 2023

(65) Prior Publication Data

US 2024/0125015 A1 Apr. 18, 2024

Related U.S. Application Data

(63) Continuation of application No. 17/884,866, filed on Aug. 10, 2022, now Pat. No. 11,891,731.

(60) Provisional application No. 63/231,528, filed on Aug. 10, 2021.

(51) Int. Cl.

| | |
|---|---|
| ***D03D 15/513*** | (2021.01) |
| ***D03D 1/00*** | (2006.01) |
| ***D03D 13/00*** | (2006.01) |
| ***D03D 15/225*** | (2021.01) |
| ***D03D 15/283*** | (2021.01) |
| ***D03D 15/47*** | (2021.01) |
| *A41D 31/08* | (2019.01) |

(52) U.S. Cl.

CPC ..... *D03D 15/513* (2021.01); *D03D 1/0035* (2013.01); *D03D 13/008* (2013.01); *D03D 15/225* (2021.01); *D03D 15/283* (2021.01); *D03D 15/47* (2021.01); *D10B 2201/24* (2013.01); *D10B 2321/08* (2013.01); *D10B 2331/021* (2013.01); *D10B 2401/063* (2013.01); *D10B 2403/0114* (2013.01); *D10B 2501/00* (2013.01)

(58) Field of Classification Search

CPC .. D03D 15/513; D03D 1/0035; D03D 13/008; D03D 15/225; D03D 15/283; D03D 15/47; D10B 2201/24; D10B 2321/08; D10B 2331/021; D10B 2401/063; D10B 2403/0114; D10B 2501/00; D10B 2201/00; D10B 2321/101; D10B 2331/02; D02G 3/443

See application file for complete search history.

(56) References Cited

U.S. PATENT DOCUMENTS

| | | | |
|---|---|---|---|
| 2,333,824 | A | 11/1943 | Shoepf |
| 2,696,723 | A | 12/1954 | Frith, Jr. |
| 3,097,442 | A | 7/1963 | Willingham, Jr. |
| 3,729,920 | A | 5/1973 | Sayers et al. |
| 3,763,644 | A | 10/1973 | Jackson, Jr. et al. |
| 3,806,959 | A | 4/1974 | Gross |
| 3,918,901 | A | 11/1975 | Ida et al. |
| 4,533,592 | A | 8/1985 | Bingham |
| 4,615,934 | A | 10/1986 | Ellison |
| 4,668,234 | A | 5/1987 | Vance et al. |
| 4,705,523 | A | 11/1987 | Hussamy |
| 4,705,527 | A | 11/1987 | Hussamy |
| 4,710,200 | A | 12/1987 | Cates et al. |
| 4,741,740 | A | 5/1988 | Davis et al. |
| 4,752,300 | A | 6/1988 | Johnson |
| 4,759,770 | A | 7/1988 | Cates et al. |
| 4,814,222 | A | 3/1989 | Davis et al. |
| 4,868,041 | A | 9/1989 | Yamagishi et al. |
| 4,898,596 | A | 2/1990 | Riggins et al. |
| 4,902,300 | A | 2/1990 | Johnson et al. |
| 4,920,000 | A | 4/1990 | Green |
| 4,970,255 | A | 11/1990 | Reimann et al. |
| 4,981,488 | A | 1/1991 | Cates et al. |
| 4,996,099 | A | 2/1991 | Cooke et al. |
| 5,043,207 | A | 8/1991 | Donovan et al. |
| 5,074,889 | A | 12/1991 | Hodge et al. |
| 5,141,542 | A | 8/1992 | Fangeat et al. |
| 5,150,476 | A | 9/1992 | Statham et al. |
| 5,174,790 | A | 12/1992 | Riggins et al. |
| 5,208,105 | A | 5/1993 | Ichibori et al. |
| 5,215,545 | A | 6/1993 | Cates et al. |
| 5,275,627 | A | 1/1994 | Cates et al. |
| 5,306,312 | A | 4/1994 | Riggins et al. |

(Continued)

FOREIGN PATENT DOCUMENTS

| | | | |
|---|---|---|---|
| AU | 2005200963 | A1 | 3/2005 |
| AU | 2007290499 | B2 | 7/2012 |

(Continued)

OTHER PUBLICATIONS

PCT Patent Application No. PCT/US2022/039918 , International Search Report and Written Opinion, Nov. 25, 2022, 13 pages.

"Fabric Flame Retardant Treatment "Precondensate"/NH3 Process", Technical Bulletin, Cotton Incorporated, TRI 4002, 2003, 12 pages.

"GlenGuard™ FR", Glen Raven Technical Fabrics, LLC, 4 pages.

"Introducing Our Lightest Dual Hazard Fabric Ever", DRIFIRE, Product Line, 2015, 3 pages.

"Pigments as Colorants: Pigmenting or Pigmentation", Textile Dyeing and Coloration, Chapter 23, 1997, 12 pages.

(Continued)

*Primary Examiner* — Robert H Muromoto, Jr.

(74) *Attorney, Agent, or Firm* — Kilpatrick Townsend & Stockton LLP

(57) ABSTRACT

Flame resistant fabrics formed with fiber blends that provide the requisite flame and thermal protection but that have improved durability. In some embodiments this is accomplished with the use of fiber blends that include relatively large percentages of FR nylon fibers in combination with cellulosic and inherently flame resistant fibers.

19 Claims, No Drawings

(56) References Cited

U.S. PATENT DOCUMENTS 5,323,815 A 6/1994 Barbeau et al.
5,356,700 A 10/1994 Tanaka et al.
5,447,540 A 9/1995 Kobayashi et al.
5,456,728 A 10/1995 Schwarz et al.
5,466,265 A 11/1995 Riegels et al.
5,488,101 A 1/1996 Ogino et al.
5,514,457 A 5/1996 Fels et al.
5,527,597 A 6/1996 Stanhope et al.
5,539,928 A 7/1996 Aldridge
5,578,368 A 11/1996 Forsten et al.
5,609,950 A 3/1997 Kampl et al.
5,640,718 A 6/1997 Aldridge
5,685,015 A 11/1997 Aldridge
5,694,981 A 12/1997 Stanhope et al.
5,724,673 A 3/1998 Aldridge
5,727,401 A 3/1998 Statham
5,776,746 A 7/1998 Denney, Jr.
5,819,316 A 10/1998 Aldridge
5,824,614 A 10/1998 Gadoury
5,830,574 A 11/1998 Gadoury
5,849,648 A 12/1998 Kent et al.
5,858,888 A 1/1999 Underwood et al.
5,885,307 A 3/1999 Gadoury
5,891,813 A 4/1999 Gadoury
5,906,891 A 5/1999 Shida et al.
5,920,905 A 7/1999 Aldridge
5,928,971 A 7/1999 Ellis et al.
6,132,476 A 10/2000 Lunsford et al.
6,146,759 A 11/2000 Land
6,184,282 B1 2/2001 Gareiss et al.
6,192,520 B1 2/2001 Underwood et al.
6,225,383 B1 5/2001 Hirono et al.
6,247,179 B1 6/2001 Underwood et al.
6,255,371 B1 7/2001 Schlosser et al.
6,342,548 B2 1/2002 Flippo et al.
6,410,140 B1 6/2002 Land et al.
6,430,754 B1 8/2002 Taylor et al.
6,451,070 B1 9/2002 Kent et al.
6,534,175 B1 3/2003 Zhu et al.
6,547,835 B1 4/2003 Lunsford et al.
6,626,964 B1 9/2003 Lunsford et al.
6,668,868 B2 12/2003 Howland et al.
6,693,052 B2 2/2004 Howland
6,706,650 B2 3/2004 Gibson et al.
6,735,789 B2 5/2004 Kelleher et al.
6,787,228 B2 9/2004 Campbell et al.
6,818,024 B2 11/2004 Lunsford et al.
6,840,288 B2 1/2005 Zhu et al.
6,861,378 B2 3/2005 Cunningham et al.
6,867,154 B1 3/2005 Lunsford et al.
6,946,412 B2 9/2005 Campbell et al.
6,974,785 B1 12/2005 Barbeau et al.
7,013,496 B2 3/2006 Dunn
7,065,950 B2 6/2006 Zhu et al.
7,073,538 B2 7/2006 Bhatnagar et al.
7,156,883 B2 1/2007 Lovasic et al.
7,284,398 B2 10/2007 Hubner
7,393,800 B2 7/2008 Corner
7,402,538 B2 7/2008 Bader et al.
7,473,659 B2 1/2009 Sytz
7,589,036 B2 9/2009 Corner et al.
7,634,819 B2 12/2009 Grey
7,676,855 B2 3/2010 Dunn
7,703,405 B2 4/2010 Bridgeman et al.
7,854,017 B2 12/2010 Laton
7,862,865 B2 1/2011 Truesdale, III et al.
RE42,209 E 3/2011 Lunsford et al.
8,017,532 B2 9/2011 Okada
8,071,492 B2 12/2011 Hess et al.
8,133,584 B2 3/2012 Zhu
8,327,469 B2 12/2012 Curtis
8,347,420 B2 1/2013 Kruszewski et al.
8,528,120 B2 9/2013 Underwood et al.
8,536,076 B1 9/2013 Byles
8,614,156 B2 12/2013 Hess et al.
8,652,975 B1 2/2014 Atkinson et al.
8,703,631 B2 4/2014 Sytz
8,741,789 B2 6/2014 Li et al.
8,898,821 B2 * 12/2014 Stanhope ..... A62B 17/003 2/81
9,034,777 B2 5/2015 Hines et al.
9,259,599 B2 2/2016 Stanhope et al.
9,370,212 B2 6/2016 Zhu
9,683,315 B2 6/2017 Schmitt et al.
9,706,804 B1 7/2017 Emery et al.
9,765,454 B2 9/2017 Tutterow et al.
9,878,185 B2 1/2018 Underwood et al.
9,938,645 B2 4/2018 Stanhope et al.
9,988,745 B2 6/2018 Sanchez et al.
10,030,326 B2 7/2018 Hines, Jr. et al.
10,072,365 B2 9/2018 Birk et al.
10,101,128 B2 10/2018 Cushingham et al.
10,183,465 B1 1/2019 Bowman et al.
10,316,440 B2 * 6/2019 Stanhope ..... D03D 15/513
10,385,479 B2 8/2019 Capwell et al.
10,385,481 B2 8/2019 Underwood et al.
10,422,055 B2 9/2019 Sytz
10,485,281 B2 11/2019 Stanhope et al.
10,487,424 B2 * 11/2019 Stanhope ..... D01F 1/04
10,640,893 B2 5/2020 Sarzotti et al.
10,704,169 B2 7/2020 Habicht et al.
10,774,451 B2 * 9/2020 Stanhope ..... D03D 27/08
10,870,932 B2 * 12/2020 Stanhope ..... D03D 15/233
11,306,418 B2 * 4/2022 Stanhope ..... D03D 1/0035
11,421,348 B2 8/2022 Stanhope et al.
11,873,587 B2 1/2024 Adams et al.
11,891,731 B2 * 2/2024 Self ..... D02G 3/443
2001/0009832 A1 7/2001 Shaffer et al.
2002/0016985 A1 2/2002 Kelleher et al.
2002/0064654 A1 5/2002 Luo et al.
2002/0069453 A1 6/2002 Kelleher et al.
2002/0182967 A1 12/2002 Erb, Jr. et al.
2003/0082972 A1 5/2003 Monfalcone, III et al.
2003/0098068 A1 5/2003 Chi et al.
2003/0148689 A1 8/2003 Lapierre
2003/0167580 A1 9/2003 Lunsford et al.
2003/0226612 A1 12/2003 Zhu et al.
2003/0228812 A1 12/2003 Stanhope et al.
2003/0228821 A1 12/2003 Zhu et al.
2003/0232560 A1 12/2003 Corner
2004/0001978 A1 1/2004 Bader et al.
2004/0029473 A1 2/2004 McKee et al.
2004/0045103 A1 3/2004 Lunsford et al.
2004/0065072 A1 4/2004 Zhu et al.
2004/0076824 A1 4/2004 Urabe et al.
2004/0152378 A1 8/2004 Stanhope et al.
2004/0192134 A1 9/2004 Gibson et al.
2005/0025962 A1 2/2005 Zhu et al.
2005/0025963 A1 * 2/2005 Zhu ..... D02G 3/443 428/364
2005/0032449 A1 2/2005 Lovasic et al.
2005/0050619 A1 3/2005 Dunn
2005/0060820 A1 3/2005 Lunsford et al.
2005/0064020 A1 3/2005 Schuette et al.
2005/0119379 A1 6/2005 Martens et al.
2005/0197028 A1 9/2005 Hartgrove et al.
2005/0208855 A1 9/2005 Zhu
2005/0245163 A1 11/2005 Aneja et al.
2005/0287364 A1 12/2005 Zhu et al.
2006/0030228 A1 2/2006 Truesdale, III
2006/0040575 A1 2/2006 Kelleher et al.
2006/0068664 A1 3/2006 Gibson et al.
2006/0084337 A1 4/2006 Corner et al.
2006/0116043 A1 6/2006 Hope et al.
2006/0143809 A1 7/2006 Dunn
2006/0264136 A1 11/2006 Chiantese
2006/0266986 A1 11/2006 Day et al.
2006/0292953 A1 12/2006 Ashley et al.
2007/0026752 A1 2/2007 Thiriot et al.
2007/0123127 A1 5/2007 Hirschmann et al.
2007/0137012 A1 6/2007 Laton
2007/0148455 A1 6/2007 Ke
2007/0178788 A1 8/2007 Link et al.
2007/0184737 A1 8/2007 Corner et al.

(56) References Cited

U.S. PATENT DOCUMENTS

2007/0248765 A1 10/2007 Truesdale et al.
2007/0249247 A1 10/2007 Truesdale, III et al.
2007/0249250 A1 10/2007 Servajean
2008/0057807 A1 3/2008 Tutterow et al.
2008/0086798 A1 4/2008 Allen, II et al.
2008/0139752 A1 6/2008 De et al.
2008/0148468 A1 6/2008 Laton et al.
2008/0152888 A1 6/2008 Tutterow et al.
2008/0182470 A1 7/2008 Fang et al.
2008/0227352 A1 9/2008 Byles et al.
2008/0295232 A1 12/2008 Truesdale, III et al.
2009/0030111 A1 1/2009 Barnes et al.
2009/0139016 A1 6/2009 Zhu et al.
2009/0178186 A1 7/2009 Truesdale
2009/0226653 A1 9/2009 Harris et al.
2009/0255038 A1 10/2009 Curtis
2010/0009186 A1 1/2010 Zhu
2010/0024103 A1 2/2010 Kelleher et al.
2010/0075557 A1 3/2010 Shteiyer
2010/0112312 A1 5/2010 Tutterow et al.
2010/0143683 A1 6/2010 Chiou
2010/0210162 A1 8/2010 Li et al.
2010/0297905 A1 11/2010 Ulrich et al.
2010/0299816 A1 12/2010 Zhu
2010/0299817 A1 12/2010 Zhu
2011/0010827 A1 1/2011 Stanhope et al.
2011/0023206 A1 2/2011 Dunn et al.
2011/0138523 A1 6/2011 Layson, Jr. et al.
2011/0159364 A1 6/2011 Nishinaka et al.
2011/0250810 A1 10/2011 Zhu
2011/0275263 A1 11/2011 Li et al.
2011/0281097 A1 11/2011 Li et al.
2012/0031783 A1 2/2012 Fay, III et al.
2012/0090080 A1* 4/2012 Stanhope ..... D03D 41/00 442/302
2012/0102632 A1 5/2012 Zhu
2012/0122361 A1 5/2012 Hand et al.
2012/0159697 A1 6/2012 Zhu
2012/0171918 A1 7/2012 Lawson, III et al.
2012/0183747 A1 7/2012 Bader et al.
2012/0210481 A1 8/2012 Rock et al.
2012/0244772 A1 9/2012 Elder
2012/0270456 A1 10/2012 Gstettner et al.
2012/0286177 A1 11/2012 Cliver et al.
2013/0008554 A1 1/2013 Fisher et al.
2013/0055490 A1 3/2013 Zhu
2013/0055491 A1 3/2013 Zhu
2013/0065470 A1 3/2013 Rock et al.
2013/0149932 A1 6/2013 Leitner et al.
2013/0212790 A1 8/2013 Waxman et al.
2013/0216810 A1 8/2013 Hines et al.
2013/0244527 A1 9/2013 Sarzotti et al.
2014/0026303 A1 1/2014 Zhu
2014/0187113 A1 7/2014 Hines, Jr. et al.
2014/0208491 A1 7/2014 Schmitt et al.
2014/0261852 A1* 9/2014 Bonner ..... D02G 1/18 139/420 A
2015/0086758 A1 3/2015 Tutterow et al.
2015/0297919 A1 10/2015 Stanhope et al.
2015/0322598 A1 11/2015 Stanhope et al.
2015/0361599 A1 12/2015 Minor
2016/0145778 A1* 5/2016 Stanhope ..... D02G 3/443 139/420 A
2016/0201236 A1 7/2016 Matsumoto et al.
2016/0362831 A1 12/2016 Minor
2017/0175302 A1 6/2017 Habicht et al.
2017/0203540 A1 7/2017 Colatruglio et al.
2017/0295875 A1 10/2017 Ohzeki et al.
2017/0370032 A1 12/2017 Stanhope et al.
2018/0002840 A1 1/2018 Tutterow et al.
2018/0030627 A1 2/2018 Stanhope et al.
2018/0127899 A1* 5/2018 Tutterow ..... D03D 15/513
2018/0171516 A1* 6/2018 Stanhope ..... D02G 3/443
2018/0245251 A1 8/2018 Dash et al.
2018/0274136 A1 9/2018 Guo et al.
2018/0313006 A1* 11/2018 Stanhope ..... D03D 15/283
2018/0371647 A1 12/2018 Sato et al.
2019/0242038 A1* 8/2019 Stanhope ..... D03D 15/225
2019/0301059 A1 10/2019 Flack et al.
2019/0309451 A1 10/2019 King et al.
2020/0308735 A1* 10/2020 Adams ..... D03D 15/513
2021/0164133 A1* 6/2021 Adams ..... D02G 3/443
2021/0292936 A1 9/2021 Ringo

FOREIGN PATENT DOCUMENTS

BE 1015931 11/2005
CA 2078626 C 4/1999
CN 1172508 A 2/1998
CN 1201474 A 12/1998
CN 1575359 A 2/2005
CN 1950455 A 4/2007
CN 101166852 A 4/2008
CN 101263253 A 9/2008
CN 101326315 A 12/2008
CN 101611182 A 12/2009
CN 101657573 A 2/2010
CN 101754998 A 6/2010
CN 102859055 A 1/2013
CN 102995224 A 3/2013
CN 103221597 A 7/2013
CN 103603123 A 2/2014
CN 103857837 A 6/2014
CN 104685118 A 6/2015
CN 105220314 B 3/2017
CN 107034574 A 8/2017
CN 107075752 A 8/2017
CN 108474147 A 8/2018
CN 110760978 A 2/2020
DE 202004005008 U1 6/2004
DE 202010011193 U1 12/2010
EP 0330163 A2 8/1989
EP 0364194 A2 4/1990
EP 0559128 A1 9/1993
EP 0412195 B1 6/1995
EP 1247885 10/2002
EP 1754813 A1 2/2007
EP 1767677 A1 3/2007
EP 2096199 A1 9/2009
EP 1498522 B1 9/2010
EP 2567945 A2 3/2013
EP 2738294 A1 6/2014
EP 3425093 A1 1/2019
EP 3831992 B1 1/2022
FR 2514934 A1 4/1983
FR 2691721 A1 12/1993
FR 2836932 A1 9/2003
GB 1126432 9/1968
GB 2025789 A 1/1980
JP H01-221537 A 9/1989
JP 02127466 A 5/1990
JP H04-501221 A 3/1992
JP 08158201 A 6/1996
JP 08209486 A 8/1996
JP 08260286 A 10/1996
JP 2703390 B2 1/1998
JP 1088448 A 4/1998
JP H10-280230 A 10/1998
JP 2000-303257 A 10/2000
JP 2000-328363 A 11/2000
JP 2001-234066 A 8/2001
JP 2003-105659 A 4/2003
JP 2005-532484 A 10/2005
JP 2007-500802 A 1/2007
JP 2007-500803 A 1/2007
JP 2007-507595 A 3/2007
JP 2008-031618 A 2/2008
JP 2008208509 A 9/2008
JP 2011-502218 A 1/2011
JP 5090778 B2 9/2012
JP 2013-542334 A 11/2013
JP 2014-525520 A 9/2014
JP 2014-529690 A 11/2014
JP 5887366 B2 2/2016

(56) References Cited

FOREIGN PATENT DOCUMENTS

| | | | |
|---|---|---|---|
| JP | 5887376 | B2 | 2/2016 |
| KR | 93-9831 | B1 | 10/1993 |
| KR | 1020060122840 | A | 11/2006 |
| KR | 1020070012391 | A | 1/2007 |
| RU | 2402648 | C1 | 10/2010 |
| TW | 200538499 | A | 12/2005 |
| TW | 200613448 | A | 5/2006 |
| TW | 200617097 | A | 6/2006 |
| WO | 93/24690 | A1 | 12/1993 |
| WO | 2000/00686 | A1 | 1/2000 |
| WO | 02/20887 | A2 | 3/2002 |
| WO | 02/052077 | A2 | 7/2002 |
| WO | 2004/002254 | A1 | 1/2004 |
| WO | 2004/005606 | A1 | 1/2004 |
| WO | 2004/088023 | | 10/2004 |
| WO | 2005/033192 | A1 | 4/2005 |
| WO | 2005/090660 | A1 | 9/2005 |
| WO | 2005/092132 | A1 | 10/2005 |
| WO | 2005/095685 | A1 | 10/2005 |
| WO | 2006/008900 | A1 | 1/2006 |
| WO | 2006/017709 | | 2/2006 |
| WO | 2006/034131 | A2 | 3/2006 |
| WO | 2006/043958 | A1 | 4/2006 |
| WO | 2006/049626 | A1 | 5/2006 |
| WO | 2006/101933 | A2 | 9/2006 |
| WO | 2007/061423 | A2 | 5/2007 |
| WO | 2007/070079 | A1 | 6/2007 |
| WO | 2007/133177 | A2 | 11/2007 |
| WO | 2008/027454 | A1 | 3/2008 |
| WO | 2008/048308 | A2 | 4/2008 |
| WO | 2009/101930 | A1 | 8/2009 |
| WO | 2010/091476 | A1 | 8/2010 |
| WO | 2010135423 | A1 | 11/2010 |
| WO | 2011/056467 | A2 | 5/2011 |
| WO | 2012/040332 | A2 | 3/2012 |
| WO | 2012/077681 | A1 | 6/2012 |
| WO | 2012/121759 | A2 | 9/2012 |
| WO | 2013/074181 | A2 | 5/2013 |
| WO | 2016/010659 | A1 | 1/2016 |
| WO | 2016/033593 | A1 | 3/2016 |
| WO | 2017/070529 | A1 | 4/2017 |
| WO | 2017/150341 | A1 | 9/2017 |

OTHER PUBLICATIONS

"Polyesters and Polyamides", Conclusions and future Trends, Woodhead Publishing Limited, Woodhead Publishing in Textiles, No. 71, 2008, p. 320.

"Ready for Action", Lion, Dec. 21, 2011, 60 pages.

"Tools & Technologies: Fire Service Prepares for Change in PPE Technology", Trade Journal, Firehouse, vol. 37, Feb. 1, 2012, 3 pages.

Horrocks et al., "Fabric Flame Retardant Treatment", Fire Retardant Materials, vol. 148, 2003.

Mathur et al., "Color and Weave Relationship in Woven Fabrics", Advances in Modern Woven Fabrics Technology, IntechOpen, Jul. 27, 2011, 24 pages.

Smith , "Lyocell—One Fiber, Many Faces", Ohio State University, Available Online at: http://web.archive.org/web/20060830212533/http://ohioline.osu.edu/hyg-fact/5000/5572.html, Aug. 30, 2016, pp. 1-5.

Yang et al., "A Durable Flame Retardant for Cellulosic Fabrics", Polymer degradation and stability, vol. 97, No. 11, Nov. 1, 2012, pp. 2467-2472.

*Notice of Allowance, U.S. Appl. No. 17/884,866, filed Sep. 22, 2023, 11 pages.

* cited by examiner

FLAME RESISTANT FABRICS

CROSS-REFERENCE TO RELATED APPLICATIONS

This application is a continuation of U.S. patent application Ser. No. 17/884,866, filed Aug. 10, 2022 and entitled "Flame Resistant Fabrics," allowed, which claims the benefit of U.S. Provisional Application No. 63/231,528, filed Aug. 10, 2021 and entitled "Flame Resistant Fabrics," the entirety of both of which is hereby incorporated by reference.

FIELD OF THE INVENTION

Embodiments of the present invention relate to flame resistant protective fabrics made with flame resistant nylon fibers that impart strength and durability to the fabric without sacrificing the flame resistance of the fabric.

BACKGROUND

Protective garments are designed to protect the wearer from hazardous environmental conditions the wearer might encounter. Such garments include those designed to be worn by firefighters and other rescue personnel, industrial and electrical workers, and military personnel, all of whom can be exposed to extreme heat and flames in the course of their occupations. Such individuals risk serious burn injury unless they are properly protected. To avoid being injured while working in such conditions, these individuals typically wear protective garments constructed from flame resistant fabrics designed to protect them against heat and flames. In addition to flame resistance, such garments must also exhibit high strength and durability to withstand the extreme conditions to which the wearers of such garments are often exposed. However, often the most durable materials are not flame resistant and thus only limited amounts of such materials can be used without sacrificing the overall flame resistance properties of the fabric. For example, polyamide materials such as nylon are highly durable but are prone to melt and burn when subjected to heat and flame, thus posing a risk to the wearer of garments made from these materials. Thus, historically it was necessary to strike a balance between the flame resistance and durability of fabrics, with flame resistance typically taking priority.

Standards have been promulgated that govern the performance of such garments (or constituent layers or parts of such garments) to ensure that the garments sufficiently protect the wearer in hazardous situations. There is a need for a fabric with improved durability that still complies with all requisite thermal protective properties.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the present invention relate to flame resistant fabrics formed with fiber blends that provide the requisite flame and thermal protection but that have improved durability. In some embodiments this is accomplished with the use of fiber blends that include relatively large percentages of flame resistant ("FR") nylon fibers.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention relate to flame resistant fabrics formed with fiber blends that provide the requisite flame and thermal protection but that have improved durability. In some embodiments this is accomplished with the use of fiber blends that include relatively large percentages of flame resistant ("FR") nylon fibers.

While all the yarns in the fabric may have the same fiber blend, in other embodiments the fabric has anisotropic properties in that the fabric is constructed such that the body side of the fabric (the side of the fabric proximate the wearer (assuming the fabric will be incorporated into a garment)) and the face side of the fabric (the side of the fabric facing away from the wearer) have different properties. Fabrics according to such embodiments can be formed pursuant to any method that results in the fabric having different properties on the body side and the face side of the fabric. In some embodiments, the fabrics are a woven, knitted, and/or nonwoven fabric.

Woven and/or knitted fabrics may be formed to have anisotropic properties through the use of at least a first group of yarns and a second group of yarns, whereby each yarn group has a different fiber blend. The different fiber blends can be attributable to the two yarn groups having different amounts of the same fibers or to the two yarn groups having different fibers or different blends of fibers. In addition, it will be recognized that in some embodiments the yarns need not be blended at all. In other words, some yarns could be 100 weight percent ("wt. %") of a single fiber type. Regardless, the first group of yarns is predominantly exposed on the face side of the fabric and the second group of yarns is predominantly exposed on the body side of the fabric. In some embodiments, the fabric is formed only of the first group of yarns and the second group of yarns (i.e., these two yarn groups form the entirety of the fabric). In other embodiments, yarns in addition to the first and second groups of yarns may be incorporated into the fabric.

Fabrics of the invention may be formed with spun yarns, filament yarns, stretch broken yarns, or combinations thereof. The yarns can comprise a single yarn or two or more individual yarns that are combined together in some form, including, but not limited to, twisting, plying, tacking, wrapping, covering, core-spinning (i.e., a filament or spun core at least partially surrounded by spun fibers or yarns), etc.

In some embodiments, the yarns of the first group of yarns ("first yarns") and the second group of yarns ("second yarns") are spun yarns each having a fiber blend that includes inherently flame resistant fibers to impart flame resistance and strength to the fabric. Examples of suitable inherently flame resistant fibers include, but are not limited to, para-aramid fibers, meta-aramid fibers, polybenzoxazole ("PBO") fibers, polybenzimidazole ("PBI") fibers, modacrylic fibers, poly{2,6-diimidazo[4,5-b:40; 50-e]-pyridinylene-1,4(2,5-dihydroxy)phenylene} ("PIPD") fibers, polyacrylonitrile (PAN) fibers, liquid crystal polymer fibers, glass fibers, carbon fibers, TANLON™ fibers (available from Shanghai Tanlon Fiber Company), wool fibers, melamine fibers (such as BASOFIL™, available from Basofil Fibers), polyetherimide fibers, pre-oxidized acrylic fibers, polyamide-imide fibers such as KERMEL™, polytetrafluoroethylene fibers, polyetherimide fibers, polyimide fibers, and polyimide-amide fibers and any combination or blend thereof. Examples of para-aramid fibers include KEVLAR™ (available from DuPont), TECHNORA™ (available from Teijin Twaron BV of Arnheim, Netherlands), and TWARON™ (also available from Teijin Twaron BY), and Taekwang para-aramid (available from Taekwang Industries). Examples of meta-aramid fibers include NOMEX™ (available from DuPont), CONEX™ (available from Teijin), APYEIL™ (available from Unitika), ARAWIN (available from Toray). An example of suitable modacrylic fibers are PROTEX™ fibers available from Kaneka Corporation of Osaka, Japan, SEF™ available from Solutia, or blends thereof.

The same type(s) of inherently flame resistant fibers may be used in the first and second yarns, but such is not a requirement. Alternatively, different types of inherently flame resistant fibers may be provided in these blends.

In some embodiments, cellulosic fibers may be added to the fiber blend(s) of the first and/or second yarns to reduce cost and impart comfort and dye-/print-ability to the fabric. Such cellulosic fibers include, but are not limited to, natural and synthetic cellulosic fibers such as cotton, rayon, acetate, triacetate, and lyocell, as well as their flame resistant counterparts FR cotton, FR rayon, FR acetate, FR triacetate, and FR lyocell. An example of FR rayon fibers is Lenzing FR™ fibers, also available from Lenzing Fibers Corporation, and VISIL™ fibers, available from Sateri. Examples of lyocell fibers include TENCEL™, TENCEL G100™ and TENCEL A100™ fibers, all available from Lenzing Fibers Corporation.

In some embodiments, blends of different cellulosic fibers are used in the fiber blend(s) of the first and/or second yarns. While the cellulosic fibers can be treated to be flame resistant, this is not necessary. Rather, inclusion of the inherently flame resistant fibers in the fiber blends imparts sufficient flame resistance and prevents the cellulosic fibers from burning.

In some embodiments, FR nylon fibers are added to the fiber blend(s) of the first and/or second yarns to impart strength and abrasion resistance and thus enhance the durability and wear properties of the fabric made with such yarns. However, because the nylon fibers are flame resistant, they do not detrimentally impact the flame resistant properties of the overall fabric made with the blend.

Some embodiments of the fabric are formed with the first and/or second yarns having a combination of cellulosic (e.g., lyocell), modacrylic, aramid (meta-aramid, para-aramid, or blends thereof), and FR nylon fibers. In some embodiments, the first yarns include approximately (i) 5-20 wt. % aramid fibers, 5-20 wt % modacrylic fibers, 30-50 wt. % cellulosic fibers, and 30-50 wt. % FR nylon fibers, inclusive; and/or (ii) 5-15 wt. % aramid fibers, 5-15 wt. % modacrylic fibers, 35-45 wt. % cellulosic fibers, and 35-45 wt. % FR nylon fibers, inclusive. In some embodiments, the second yarns include approximately (i) 5-20 wt. % aramid fibers, 5-20 wt. % cellulosic fibers, 30-50 wt. % modacrylic fibers, and 30-50 wt. % FR nylon fibers, inclusive; and/or (ii) 5-15 wt. % aramid fibers, 5-15 wt. % cellulosic fibers, 35-45 wt. % modacrylic fibers, and 35-45 wt. % FR nylon fibers, inclusive. In some embodiments, the cellulosic fibers are non-FR lyocell fibers. In some embodiments, the aramid fibers are para-aramid fibers. In some embodiments, the first and second yarns include the same types of fibers, just different weight percentages of some or all of the fibers. In some embodiments, the first and second yarns include approximately the same weight percentage of FR nylon and aramid fibers but different weight percentages of the cellulosic and modacrylic fibers. In some embodiments, the wt. % of FR nylon fibers in the first and/or second yarns is greater than the wt. % of aramid fibers in the first and/or second yarns. In some embodiments, the wt. % of FR nylon fibers in the first and/or second yarns is greater than the wt. % of modacrylic fibers in the first and/or second yarns. In some embodiments, the wt. % of FR nylon fibers in the first and/or second yarns is greater than the combined wt. % of all of the inherently FR fibers (e.g., the modacrylic fibers and the aramid fibers) in the first and/or second yarns. In some embodiments, the first yarns are warp yarns and the second yarns are fill yarns.

In some embodiments, the first or second yarns are formed from a fiber blend that includes a combination of only cellulosic (e.g., lyocell), modacrylic, aramid (meta-aramid, para-aramid, or blends thereof), and FR nylon fibers and that is devoid of other types of fibers. In some embodiments, the first and second yarns are both formed from a fiber blend that includes a combination of only cellulosic (e.g., lyocell), modacrylic, aramid (meta-aramid, para-aramid, or blends thereof), and FR nylon fibers and that is devoid of other types of fibers.

In some embodiments, the overall fabric fiber blend of the fabric includes approximately (i) 5-20 wt. % aramid fibers, 15-40 wt. % modacrylic fibers, 15-40 wt. % cellulosic fibers, and 30-50 wt. % FR nylon fibers, inclusive; (ii) 5-15 wt. % aramid fibers, 15-30 wt. % modacrylic fibers, 15-30 wt. % cellulosic fibers, and 35-45 wt. % FR nylon fibers, inclusive; and/or (iii) 8-12 wt. % aramid fibers, 20-30 wt. % modacrylic fibers, 20-30 wt. % cellulosic fibers, and 35-45 wt. % FR nylon fibers, inclusive. In some embodiments, the overall fabric fiber blend includes approximately (i) 10 wt. % aramid fibers, 25 wt. % modacrylic fibers, 25 wt. % cellulosic fibers, and 40 wt. % FR nylon fibers, inclusive. In some embodiments, the cellulosic fibers are non-FR lyocell fibers. In some embodiments, the aramid fibers are para-aramid fibers. In some embodiments, the wt. % of FR nylon in the fabric fiber blend is more than the wt. % of each of the other fibers in the fabric fiber blend. In some embodiments, the wt. % of FR nylon fibers in the fabric fiber blend is greater than the combined wt. % of all of the inherently FR fibers (e.g., the modacrylic fibers and the aramid fibers) in the fabric fiber blend. In some embodiments, the fabric fiber blend includes a combination of only cellulosic (e.g., lyocell), modacrylic, aramid (meta-aramid, para-aramid, or blends thereof), and FR nylon fibers and is devoid of other types of fibers.

In some embodiments, the fabrics are woven fabrics formed of the first yarns and the second yarns. In some embodiments, only the first yarns will be oriented in the warp direction and only the second yarns will be oriented in the fill direction such that the fibers on the face side of the fabric will predominantly comprise those of the first yarns and the fibers on the body side of the fabric will predominantly comprise those of the second yarns. In this way and in some embodiments, more cellulosic fibers will be exposed on the face side of the fabric to receive dye and other coloration.

In other embodiments, not all of the warp or fill yarns are the same. For example, the first and second yarns may be provided in both the warp and fill directions by providing the first yarns on some ends and picks and the second yarns on other ends and picks (in any sort of random arrangement or alternating pattern). Or all of the yarns in one of the warp or fill direction could be identical (e.g., either all first yarns or all second yarns) and different yarns (both first and second yarns) used only in the other of the warp or fill direction.

The fabric may be constructed with the first and second yarns in a variety of ways, including but not limited to, one or more of twill weave (2×1, 3×1, etc.), twill weave containing a rip-stop pattern, satin weave (4×1, 5×1, etc.), sateen weave, and double-cloth constructions, or any other weave where yarn is predominantly more on one side of the fabric than the other side of the fabric. A person skilled in the art would be familiar with and could utilize suitable fabric constructions.

It will also be recognized that any woven fabric will have both warp and fill yarns visible on each side of the fabric. Fabrics woven in accordance with some embodiments of the present invention, however, are woven such that more of the first yarns are located on the face side of the fabric, and thus more of the second yarns are located on the body side of the fabric. Thus, in an exemplary fabric construction in which more of the first yarns are located or exposed on the face side of the fabric and more of the second yarns are located or exposed on the body side of the fabric, the first yarns are "predominantly" exposed on the face side of the fabric (even though some of the first yarns would be visible from the body side of the fabric) and the second yarns are "predominantly" exposed on the body side of the fabric (even though some of the second yarns would be visible from the face side of the fabric).

In other embodiments of the invention, a knit fabric that has different properties on each side of the fabric can be constructed. Such a fabric could be constructed using double-knit technology such that the first yarns will be predominantly exposed on the face side of the fabric and the second yarns will be predominantly exposed on the opposing body side of the fabric.

Embodiments of the fabric can be of any weight, but in some embodiments are between 3 to 12 ounces per square yard (osy), inclusive; 4 to 10 osy, inclusive; and/or 5 to 9 osy, inclusive. In some embodiments, the fabric weight is at least 5 osy but less than or equal to 9 osy; at least 5.5 osy but less than or equal to 8 osy; at least 6 osy but less than or equal to 7.5 osy; and/or at least 6 osy but less than or equal to 7 osy.

In one non-limiting embodiment, an Example Fabric was formed having the fiber blends for the first and second yarns as set forth in Table 1:

TABLE 1

| | First (Warp) Yarns | Second (Fill) Yarns |
|---|---|---|
| Example Fabric: | 40 wt. % FR nylon<br>40 wt. % non-FR lyocell<br>10 wt. % modacrylic<br>10 wt. % para-aramid | 40 wt. % FR nylon<br>10 wt. % non-FR lyocell<br>40 wt. % modacrylic<br>10 wt. % para-aramid |

Each of the first and second yarns were 17/1 cc spun yarns.

Table 2 sets forth testing results of various properties of the Example Fabric. All of the testing methodologies and standards referenced herein are incorporated by reference in their entireties. Prior to testing, the Example Fabric was finished but without the use of any property-imparting (e.g., flame retardant) additive.

TABLE 2

| Characteristic | Example Fabric | Desired Performance | Test Method |
|---|---|---|---|
| Weight (osy) | 6.3 | — | ASTM D 3776 |
| Construction (w × f) | 79 × 54 | — | |
| Weave Pattern | Twill | — | |
| Vertical Flammability | | | ASTM D 6413 |
| Before Laundering: | | | |
| After flame, seconds | 0 × 0 | ≤2.0 × 2.0 | |
| Char length, inches | 4.4 × 4.6 | ≤6.0 × 6.0 | |
| Melt/Drip | None | None | |
| After 50 Launderings: | | | |
| After flame, seconds | 0 × 0 | ≤2.0 × 2.0 | |
| Char length, inches | 4.0 × 4.1 | ≤6.0 × 6.0 | |
| Melt/Drip | None | None | |
| After 100 Launderings: | | | |
| After flame, seconds | 0 × 0 | ≤2.0 × 2.0 | |
| Char length, inches | 4.3 × 3.4 | ≤6.0 × 6.0 | |
| Melt/Drip | None | None | |
| Instrumented Manikin Burn (Excluding Head Sensors) | | | ASTM F1930 |
| Burn Injury, % (3-sec) | 4 | ≤30 | |
| Burn Injury, % (4-sec) | 27 | ≤30 | |
| Breaking Strength (before wash), lbf | | | ASTM D 5034 |
| Warp | 178 | ≥150 | |
| Fill | 133 | ≥100 | |
| Tearing Strength (before wash), lbf | | | ASTM D 1424 |
| Warp | 10.5 | ≥8.0 | |
| Fill | 9.4 | ≥8.0 | |
| Seam Strength, lbf | | | ASTM D 1683 |
| Before Permanent Press/ Permethrin | 161 | ≥110 | |
| After Permanent Press/ Permethrin | 131 | ≥110 | |
| pH | 6.7 | 5.0-8.5 | AATCC-81 |
| TPP | | | ASTM F2700 |
| With spacer | 12.2 | — | |
| Without spacer | 8.2 | — | |
| Arc Rating (cal/cm$^2$) | 6.7 | ≥4 | ASTM 1959 |

Where indicated, the Example Fabric was laundered in accordance with AATCC Method 135, 1, IV, A i (*Dimensional Changes of Fabrics after Home Laundering,* 2018 edition).

Vertical flammability (char length, after flame, and melt/drip) were tested in accordance with ASTM D6413: *Standard Test Method for Flame Resistance of Textiles* (*Vertical Test*) (2015 edition). To test for char length and afterflame, a fabric specimen is suspended vertically over a flame for twelve seconds. The fabric must self-extinguish within two seconds (i.e., it must have a 2 second or less afterflame).

After the fabric self-extinguishes, a specified amount of weight is attached to the fabric and the fabric lifted so that the weight is suspended from the fabric. The fabric will typically tear along the charred portion of the fabric, and the length of the tear (i.e., the char length) is measured. The test is performed in both the machine/warp and cross-machine/weft directions of the fabric. A fabric sample is typically tested for compliance both before it has been washed (and thus when the fabric still contains residual—and often flammable—chemicals from finishing processes) and after a certain number of launderings.

The Example Fabric was also subjected to testing pursuant to ASTM F1930 (*Standard Test Method for Evaluation of Flame-Resistant Clothing for Protection Against Fire Simulations Using an Instrumented Manikin,* 2018 edition). ASTM F1930 is designed to predict burn injury to a wearer of garments made with flame resistant fabrics. The test generally involves exposing a manikin wearing a flame resistant garment to a simulated flash fire for a specified period of time. The manikin is provided with thermal energy sensors that evaluate the thermal energy transferred through the garment during and after exposure to the flames. The predicted overall percentage of a wearer's body that would suffer second-degree burns and third-degree burns can be approximated based on the information gathered from the sensors. The predicted burn percentage is generally inversely proportional to the thermal protection of the garment in that the lower the predicted burn percentage, the more protection the garment affords the wearer.

The tensile/breaking strength of the Example Fabric was measured in accordance with ASTM D5034: *Standard Test Method for Breaking Strength and Elongation of Textile Fabrics* (*Grab Test*) (2013 edition). According to this method, a specimen is mounted centrally in clamps of a tensile machine and a force is applied until the specimen breaks. Values for the breaking force and the elongation of the test specimen are obtained from machine scales, dials, autographic recording charts, or a computer interfaced with the testing machine. The results are reported in pounds force (lbf).

Tear strength is a measure of the amount of force required to propagate in a fabric a tear after its initiation. The tear strength of fabrics is measured pursuant to ASTM D1424 (*Standard Test Method for Tearing Strength of Fabrics by Falling-Pendulum* (*Elmendorf-Type*) *Apparatus* (2013 edition)), and the results are reported in pounds force (lbf). Pursuant to ASTM D1424, a slit of a specified size is cut into a fabric sample of a specified size. A clamp is positioned on the fabric sample on each side of the slit to support the fabric sample. A weighted pendulum is released and swings down to apply a force to the fabric sample. The amount of force required to propagate the existing tear in the fabric is measured and that amount of force represents the tear strength of the fabric.

The arc rating value represents a fabric's performance when exposed to an electrical arc discharge. The arc rating is expressed in cal/cm$^2$ (calories per square centimeter) and is derived from the determined value of the arc thermal performance value (ATPV) or Energy Breakopen threshold ($E_{BT}$). ATPV is defined as the arc incident energy on a material that results in a 50 wt. % probability that sufficient heat transfer through the specimen is predicted to cause the onset of second-degree burn injury based on the Stoll Curve. $E_{BT}$ is the arc incident energy on a material that results in a 50 wt. % probability of breakopen. Breakopen is defined as any open area in the material at least 1.6 cm$^2$ (0.5 in. 2). The arc rating of a material is reported as either ATPV or $E_{BT}$, whichever is the lower value. The ATPV and $E_{BT}$ is determined pursuant to the testing methodology set forth in ASTM F1959 (*Standard Test Method for Determining the Arc Rating of Materials for Clothing,* 2014 edition), where sensors measure thermal energy properties of protective fabric specimens during exposure to a series of electric arcs.

NFPA 70E (*Standard for Electrical Safety in the Workplace,* 2021 edition) offers a method to match protective clothing to potential exposure levels incorporating Personal Protective Equipment (PPE) Categories. Protective fabrics are tested to determine their arc rating, and the measured arc rating determines the PPE Category for a fabric as follows:

PPE Category and ATPV

PPE Category 1: ATPV/$E_{BT}$: 4 cal/cm$^2$
PPE Category 2: ATPV/$E_{BT}$: 8 cal/cm$^2$
PPE Category 3: ATPV/$E_{BT}$: 25 cal/cm$^2$
PPE Category 4: ATPV/$E_{BT}$: 40 cal/cm$^2$ As evidenced by the test results in Table 2 for the Example Fabric, the flame resistant properties of fabrics according to embodiments of the invention are not jeopardized despite containing such high percentages of nylon. More specifically, embodiments of the fabrics disclosed herein have a char length of 6 inches or less (and even 5 inches or less) and a two second or less afterflame. Moreover, the predicted burn injury percentage is 30% or less after 3 seconds and after 4 seconds, when tested pursuant to ASTM F1930.

The ability to include large amounts of nylon fibers (without detrimentally impacting the FR performance of the fabric) improves the strength and durability of the fabrics in that such fabrics achieve a breaking strength of greater than 150×100 pounds force in the warp×fill directions and a tear strength of greater than 8 pounds force in the warp and fill directions. Moreover, some embodiments of the fabric achieve an arc rating (ATPV or $E_{BT}$) greater or equal to 4 cal/cm$^2$, 5 cal/cm$^2$, and/or 6 cal/cm$^2$ so as to have a PPE Category 1 rating under NFPA 70E.

The fabrics described herein can be incorporated into any type of single or multi-layer garment (uniforms, shirts, jackets, trousers and coveralls) where protection against electric arc flash and/or flames is needed and/or desirable.

EXAMPLES

A collection of exemplary embodiments, including at least some explicitly enumerated as "Examples" providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

Example 1. A flame resistant fabric formed by first yarns and a second yarns and having a fabric fiber blend, wherein the fabric has a first side and a second side opposite the first side and wherein the first yarns comprise a first yarn fiber blend comprising approximately 5-20 wt. % aramid fibers, 5-20 wt. % modacrylic fibers, 30-50 wt. % cellulosic fibers, and 30-50 wt. % FR nylon fibers; the second yarns comprise a second yarn fiber blend comprising 5-20 wt. % aramid fibers, 5-20 wt. % cellulosic fibers, 30-50 wt. % modacrylic fibers, and 30-50 wt. % FR nylon fibers; the first yarns are predominantly exposed on the first side of the fabric; the second yarns are predominantly exposed on the second side of the fabric; the fabric has a char length of 6 inches or less and an after flame of 2 seconds or less when tested pursuant to ASTM D6413 (2015); and the fabric has a fabric weight that is between 5 to 9 ounces per square yard, inclusive.

Example 2. The fabric of any of the preceding or subsequent examples or combination of examples, wherein the first yarn fiber blend comprises approximately 5-15 wt. % aramid fibers, 5-15 wt. % modacrylic fibers, 35-45 wt. % cellulosic fibers, and 35-45 wt. % FR nylon fibers.

Example 3. The fabric of any of the preceding or subsequent examples or combination of examples, wherein the second yarn fiber blend comprises approximately 5-15 wt. % aramid fibers, 5-15 wt. % cellulosic fibers, 35-45 wt. % modacrylic fibers, and 35-45 wt. % FR nylon fibers.

Example 4. The fabric of any of the preceding or subsequent examples or combination of examples, wherein the wt. % of FR nylon fibers in the first yarn fiber blend is approximately the same as the wt. % of FR nylon fibers in the second yarn fiber blend.

Example 5. The fabric of any of the preceding or subsequent examples or combination of examples, wherein the wt. % of aramid fibers in the first yarn fiber blend is approximately the same as the wt. % of aramid fibers in the second yarn fiber blend.

Example 6. The fabric of any of the preceding or subsequent examples or combination of examples, wherein at least some of the cellulosic fibers in the first yarn fiber blend and the second yarn fiber blend are non-FR lyocell fibers.

Example 7. The fabric of any of the preceding or subsequent examples or combination of examples, wherein at least some of the aramid fibers in the first yarn fiber blend and the second yarn fiber blend are para-aramid fibers.

Example 8. The fabric of any of the preceding or subsequent examples or combination of examples, wherein at least one of the first yarn fiber blend or the second yarn fiber blend is devoid of additional fiber types.

Example 9. The fabric of any of the preceding or subsequent examples or combination of examples, wherein both of the first yarn fiber blend and the second yarn fiber blend are devoid of additional fiber types.

Example 10. The fabric of any of the preceding or subsequent examples or combination of examples, wherein the wt. % of FR nylon fibers in the fabric fiber blend is greater than the combined wt. % of the modacrylic fibers and the aramid fibers in the fabric fiber blend.

Example 11. The fabric of any of the preceding or subsequent examples or combination of examples, wherein the fabric is a woven fabric comprising a warp direction and a fill direction, wherein the first yarns are provided only in the warp direction and the second yarns are provided only in the fill direction.

Example 12. A garment formed with the fabric of any of the preceding or subsequent examples or combination of examples, the garment having a face side and a body side, wherein the first side of the fabric is exposed on the face side of the garment and the second side of the fabric is exposed on the body side of the garment.

Example 13. A flame resistant fabric formed by first yarns and a second yarns and having a fabric fiber blend, wherein the fabric has a first side and a second side opposite the first side and wherein the first yarns comprise a first yarn fiber blend; the second yarns comprise a second yarn fiber blend that is different from the first yarn fiber blend; the fabric fiber blend comprises cellulosic fibers, aramid fibers, modacrylic fibers, and 30-50 wt. % FR nylon fibers; the first yarns are predominantly exposed on the first side of the fabric; the second yarns are predominantly exposed on the second side of the fabric; the fabric has a char length of 6 inches or less and an afterflame of 2 seconds or less when tested pursuant to ASTM D6413 (2015); the fabric has a fabric weight between 5 to 7 ounces per square yard, inclusive; the fabric has a break strength of at least 150 pounds force in a warp direction of the fabric and of at least 100 pounds force in a fill direction of the fabric; the fabric has a tear strength of at least 8 pounds force in at least one of the warp direction or fill direction of the fabric; and the fabric achieves a predicted burn injury percentage of 30% or less after 4 seconds, when tested pursuant to ASTM F1930 (2018).

Example 14. The fabric of any of the preceding or subsequent examples or combination of examples, wherein the fabric fiber blend comprises approximately 5-20 wt. % aramid fibers, 15-40 wt. % modacrylic fibers, and 15-40 wt. % cellulosic fibers.

Example 15. The fabric of any of the preceding or subsequent examples or combination of examples, wherein the fabric fiber blend comprises approximately 5-15 wt. % aramid fibers, 15-30 wt. % modacrylic fibers, 15-30 wt. % cellulosic fibers, and 35-45 wt. % FR nylon fibers.

Example 16. The fabric of any of the preceding or subsequent examples or combination of examples, wherein the fabric fiber blend comprises approximately 8-12 wt. % aramid fibers, 20-30 wt. % modacrylic fibers, and 20-30 wt. % cellulosic fibers.

Example 17. The fabric of any of the preceding or subsequent examples or combination of examples, wherein the wt. % of FR nylon in the fabric fiber blend is more than the wt. % of each of the cellulosic fibers, the aramid fibers, and the modacrylic fibers in the fabric fiber blend.

Example 18. The fabric of any of the preceding or subsequent examples or combination of examples, wherein the fabric has an arc rating of at least 4 cal/cm$^2$ when tested pursuant to ASTM F1959 (2014).

Example 19. The fabric of any of the preceding or subsequent examples or combination of examples, wherein each of the first yarn fiber blend and the second yarn fiber blend comprises cellulosic fibers, modacrylic fibers, aramid fibers, and FR nylon fibers.

Example 20. The fabric of any of the preceding or subsequent examples or combination of examples, wherein the wt. % of FR nylon fibers in the fabric fiber blend is greater than the combined wt. % of the modacrylic fibers and the aramid fibers in the fabric fiber blend.

Different arrangements of the components described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A flame resistant fabric comprising a fabric fiber blend and formed of a plurality of yarns, wherein:

i. each of the plurality of yarns is formed from a yarn fiber blend that comprises aramid fibers, modacrylic fibers, cellulosic fibers, and FR nylon fibers;

ii. the fabric fiber blend comprises 5-20 wt. % aramid fibers, 15-40 wt. % modacrylic fibers, 15-40 wt. % cellulosic fibers, and 30-50 wt. % FR nylon fibers, inclusive; and iii. the fabric has a char length of 6 inches or less and an afterflame of 2 seconds or less when tested pursuant to ASTM D6413 (2015).

2. The flame resistant fabric of claim 1, wherein the yarn fiber blend is identical for all of the plurality of yarns, and wherein the yarn fiber blend is identical to the fabric fiber blend.

3. The flame resistant fabric of claim 1, wherein the fabric fiber blend comprises 5-15 wt. % aramid fibers, 15-30 wt. % modacrylic fibers, 15-30 wt. % cellulosic fibers, and 35-45 wt. % FR nylon fibers, inclusive.

4. The flame resistant fabric of claim 1, wherein the wt. % of FR nylon fibers in the fabric fiber blend is greater than the wt. % of each of the aramid, modacrylic, and cellulosic fibers in the fabric fiber blend.

5. The flame resistant fabric of claim 1, wherein the wt. % of FR nylon fibers in the fabric fiber blend is greater than a combined wt. % of the modacrylic fibers and the aramid fibers in the fabric fiber blend.

6. The flame resistant fabric of claim 1, wherein the fabric fiber blend consists of 5-20 wt. % aramid fibers, 15-40 wt. % modacrylic fibers, 15-40 wt. % cellulosic fibers, and 30-50 wt. % FR nylon fibers, inclusive.

7. The flame resistant fabric of claim 1, wherein the plurality of yarns comprises a first set of yarns having a first yarn fiber blend and a second set of yarns having a second yarn fiber blend different than the first yarn fiber blend.

8. The flame resistant fabric of claim 7, wherein the first yarn fiber blend comprises approximately 5-15 wt. % aramid fibers, 5-15 wt. % modacrylic fibers, 35-45 wt. % cellulosic fibers, and 35-45 wt. % FR nylon fibers, inclusive.

9. The flame resistant fabric of claim 8, wherein the second yarn fiber blend comprises approximately 5-15 wt. % aramid fibers, 35-45 wt. % modacrylic fibers, 5-15 wt. % cellulosic fibers, and 35-45 wt. % FR nylon fibers, inclusive.

10. The flame resistant fabric of claim 7, wherein the fabric is a woven fabric comprising a warp direction and a fill direction, wherein the first set of yarns is provided only in one of the warp direction or the fill direction and the second set of yarns is provided only in the other of the warp direction or the fill direction.

11. The flame resistant fabric of claim 7, wherein the fabric is a woven fabric comprising a warp direction and a fill direction, wherein the first and second sets of yarn are both provided in at least one of the warp direction or the fill direction.

12. The flame resistant fabric of claim 1, wherein at least some of the cellulosic fibers in the fabric fiber blend are non-FR lyocell fibers.

13. The flame resistant fabric of claim 1, wherein at least some of the aramid fibers in the fabric fiber blend are para-aramid fibers.

14. The flame resistant fabric of claim 1, wherein the fabric has a weight of 3-12 ounces per square yard, inclusive.

15. A flame resistant fabric comprising a fabric fiber blend and formed of a plurality of yarns, wherein:

i. each of the plurality of yarns is formed from a yarn fiber blend that comprises aramid fibers, modacrylic fibers, cellulosic fibers, and FR nylon fibers;

ii. the fabric fiber blend comprises 5-20 wt. % aramid fibers, 15-40 wt. % modacrylic fibers, 15-40 wt. % cellulosic fibers, and 30-50 wt. % FR nylon fibers, inclusive;

iii. the wt. % of FR nylon fibers in the fabric fiber blend is greater than the wt. % of each of the aramid, modacrylic, and cellulosic fibers in the fabric fiber blend;

iv. the fabric has a char length of 6 inches or less and an afterflame of 2 seconds or less when tested pursuant to ASTM D6413 (2015);

V. the fabric has a break strength of at least 150 pounds force in a warp direction of the fabric and of at least 100 pounds force in a fill direction of the fabric;

vi. the fabric has a tear strength of at least 8 pounds force in at least one of the warp direction or fill direction of the fabric; and vii. the fabric achieves a predicted burn injury percentage of 30% or less after 4 seconds, when tested pursuant to ASTM F1930 (2018).

16. The flame resistant fabric of claim 15, wherein the yarn fiber blend is identical for all of the plurality of yarns, and wherein the yarn fiber blend is identical to the fabric fiber blend.

17. The flame resistant fabric of claim 15, wherein the fabric fiber blend comprises 5-15 wt. % aramid fibers, 15-30 wt. % modacrylic fibers, 15-30 wt. % cellulosic fibers, and 35-45 wt. % FR nylon fibers, inclusive.

18. The flame resistant fabric of claim 15, wherein the wt. % of FR nylon fibers in the fabric fiber blend is greater than a combined wt. % of the modacrylic fibers and the aramid fibers in the fabric fiber blend.

19. The flame resistant fabric of claim 15, wherein the fabric fiber blend consists of 5-20 wt. % aramid fibers, 15-40 wt. % modacrylic fibers, 15-40 wt. % cellulosic fibers, and 30-50 wt. % FR nylon fibers, inclusive.

* * * * *